United States Patent [19]

Greczin

[11] 4,003,220

[45] * Jan. 18, 1977

[54] KNITTING MACHINE INCLUDING ROTATABLE HOLD DOWN RING

[75] Inventor: John C. Greczin, Philadelphia, Pa.

[73] Assignee: Knitting Machinery Corporation of America, Philadelphia, Pa.

[ * ] Notice: The portion of the term of this patent subsequent to Apr. 29, 1992, has been disclaimed.

[22] Filed: Jan. 20, 1975

[21] Appl. No.: 542,613

Related U.S. Application Data

[63] Continuation-in-part of Ser. No. 333,969, Feb. 20, 1973, Pat. No. 3,879,961.

[52] U.S. Cl. ..... 66/9 A; 66/115

[51] Int. Cl.[2] ..... D04B 9/00

[58] Field of Search ..... 66/9 A, 8, 14, 90, 151, 66/153, 149 S

[56] References Cited

UNITED STATES PATENTS

| | | | |
|---|---|---|---|
| 1,885,322 | 11/1932 | Bentley et al. | 66/14 |
| 2,032,993 | 3/1936 | Larkin | 66/9 A |
| 2,239,378 | 4/1941 | Brillhart | 66/9 A |
| 2,406,525 | 8/1946 | Bardsley | 66/9 A |
| 2,752,952 | 7/1956 | Dauphinais | 66/9 A |
| 3,392,551 | 7/1968 | Tenconi | 66/153 X |
| 3,543,280 | 11/1967 | Greczin | 66/9 A |
| 3,871,194 | 3/1975 | Greczin et al. | 66/9 A |
| 3,879,961 | 4/1975 | Greczin | 66/9 A |

FOREIGN PATENTS OR APPLICATIONS

| | | | |
|---|---|---|---|
| 1,197,573 | 7/1965 | Germany | 66/149 S |

*Primary Examiner*—Mervin Stein
*Assistant Examiner*—Andrew M. Falik
*Attorney, Agent, or Firm*—Weiser, Stapler & Spivak

[57] ABSTRACT

A circular knitting machine of the type providing a reinforcement of knit tubular fabric for flexible hose including a plurality of circumferentially spaced, vertically reciprocating needles. A yarn guide holder is rotatable with the machine relative to the knitting needles and carries vertical supports for connection of a hold down ring. The hold down ring including a needle guide portion affixes to the yarn guide holder and is vertically adjustable relative to the yarn guide holder for gap adjustment purposes. The hold down ring and the needle guide portion is rotated by the machine relative to needles simultaneously with the rotation of the yarn guide holder in a manner to assure even wear upon the needle guide portion which may be caused by repeated contacts by the knitting needles.

5 Claims, 4 Drawing Figures

KNITTING MACHINE INCLUDING ROTATABLE HOLD DOWN RING

BACKGROUND OF THE INVENTION

This application is a continuation in part of my pending application Ser. No. 333,969 filed Feb. 20, 1973, now U.S. Pat. No. 3,879,961.

The present invention relates generally to the art of knitting, and more particularly, is directed to a circular knitting machine of relatively small diameter of the type which may be employed to knit a reinforcement of tubular fabric in place over a flexible hose as the hose is passed through the machine.

In the production of tubular knit fabrics which serve as a reinforcement for the outer side of flexible hose and which are knitted in place upon the exterior surface of the hose as it is drawn through the machine, it is desirable that the fabric should have maximum effectiveness as a reinforcement for the hose and should provide a maximum of burst strength in the finished hose. The size and disposition of the stitches in the knitted fabric have a bearing upon its effectiveness as a reinforcement in the hose. For maximum effectiveness, there should be a generally uniform distribution of the yarn components of the stitch formation in such a manner that the coursewise width of the stitches in the needle wales should be substantially equal to the distance between such wales and that the walewise length of the stitches should be substantially equal to the coursewise width in a manner to knit a generally hollow square stitch formation.

Circular knitting machines of the type encompassed by this invention are well known as exemplified in U.S. Pat. No. 2,752,952 to Dauphanais and in U.S. Pat. No. 3,543,280 to Greczin. The prior art type of circular knitting machines adapted to the hose manufacturing industry usually comprise a hollow needle cylinder through which the hollow flexible hose length passes while the reinforcing tube is continuously knit about the hollow flexible tubular element. Means are provided for moving the hollow flexible tubular element through the needle cylinder as the knit reinforcing tube is formed thereabout. Preferably, the needle cylinder is arranged with its axis vertical and the hollow flexible tubular element is usually passed upwardly through the needle cylinder as the reinforcing tube is being knit about the outer periphery thereof.

As stated in my prior U.S. Pat. No. 3,543,280, experience has shown that a suitable knit tubular fabric can be produced by using six needles or eight needles which reciprocate in equally spaced pairs of slots formed on the exterior of the needle stem, depending upon the size of the tubular hose being covered. It was the usual practice to reciprocate the knitting needles vertically within the spaced slots in the needle stem and which upwardly engage portions of the hold down ring. Inasmuch as the hold down ring was held in stationary relationship to the machine frame and the vertical orientation of the knitting needles in the prior art machines, continued operation of the machine resulted in the wearing of grooves caused by the repeated impacts and vertical movement of the knitting needles. After a period of time, the wearing action of the knitting needles resulted in the wearing of grooves in the needle guide portion of the hold down ring of sufficient depth to interfere with proper stitch formation. At that time, the entire machine had to be dismantled to remove and replace the hold down ring and any other worn parts, thereby resulting in considerable down time of the machine and in costly repairs.

Specifically, in U.S. Pat. No. 3,543,280, the hold down ring with its integral, depending needle guide portion is shown as being bolted to a hollow cylindrical support tube. In accordance with FIG. 1 of the present application, the support 28 is clearly shown to be stationary and is affixed to the machine frame 36 by suitable bolts 40, 42. Accordingly, the needle guide portion cannot rotate and so is subject to wear caused by continuous repetitious contacts by the needles 12. Similarly, in U.S. Pat. No. 2,752,952, the needle guide portion is illustrated in stationary relationship. The yarn guide is connected to the rotary head 15 and conventionally rotates with the head. The portion of the hold down ring overlying the knit tube 3 remains stationary as does the needle cylinder 4. A bearing surface between the hold down ring and the yarn guide is illustrated by a double line representation to indicate the boundary between the rotating and non-rotating parts.

In applicant's recently issued patent, U.S. Pat. No. 3,879,961, a knitting machine including a rotatable hold down ring is set forth in the manner specifically differing from the constructions of U.S. Pat. Nos. 2,752,952, and 3,543,280. In this newly issued patent, the hold down ring includes the needle guide portion integrally and the hold down ring is affixed to rotating portions of the machine rather than to stationary portions of the knitting machine. In this manner, the needle guide portion is rotated relative to the knitting needles to prevent uneven wear caused by repeated impacts of the needles.

SUMMARY OF THE INVENTION

The present invention relates in general to circular knitting machines and more particularly, is directed to a machine including necessary construction to rotate the hold down ring and yarn guide holder relative to the knitting needles.

The knitting machine of this invention incorporates a novel yarn guide holder which affixes to the machine frame in a manner to permit the yarn guide holder to be rotated by the rotary head and columns in conventional manner. The previous support tube construction has been completely eliminated. The yarn guide holder upwardly carries a pair of vertical adjustment posts upon which the hold down ring positions and is vertically adjustable. Accordingly, as the yarn guide holder is rotated, the hold down ring with its integral needle guide portion also is rotated by the machine operation relative to the vertical reciprocation of the knitting needles. Thus, the simultaneous vertical reciprocation of the knitting needles and the rotary action of the hold down ring cause the knitting needles to ride over different portions of the needle guide portion of the hold down ring during all periods of operation, thereby resulting in even wear about the periphery of the hold down ring.

It is therefore an object of the present invention to provide an improved circular knitting machine of the type set forth.

It is another object of the present invention to provide a novel knitting machine which includes means to rotate the hold down ring simultaneously with the rotation of the machine itself.

It is another object of the present invention to provide a novel knitting machine which includes means to permit vertical adjustment of the hold down ring, means to rotate the hold down ring and which eliminates the need for a support rube.

It is another object of the present invention to provide an improved knitting machine wherein the hold down ring, the yarn guide holder and the yarn guide all rotate in unison with the rotating portions of the machine and relative to the vertical orientation and operation of the knitting needles.

It is a further object of the present invention to provide a novel circular knitting machine that is inexpensive in manufacture, simple in design and trouble free when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

DESCRIPTION OF THE PREFERRED EMBODIMENT OF THE INVENTION

Figure 1:
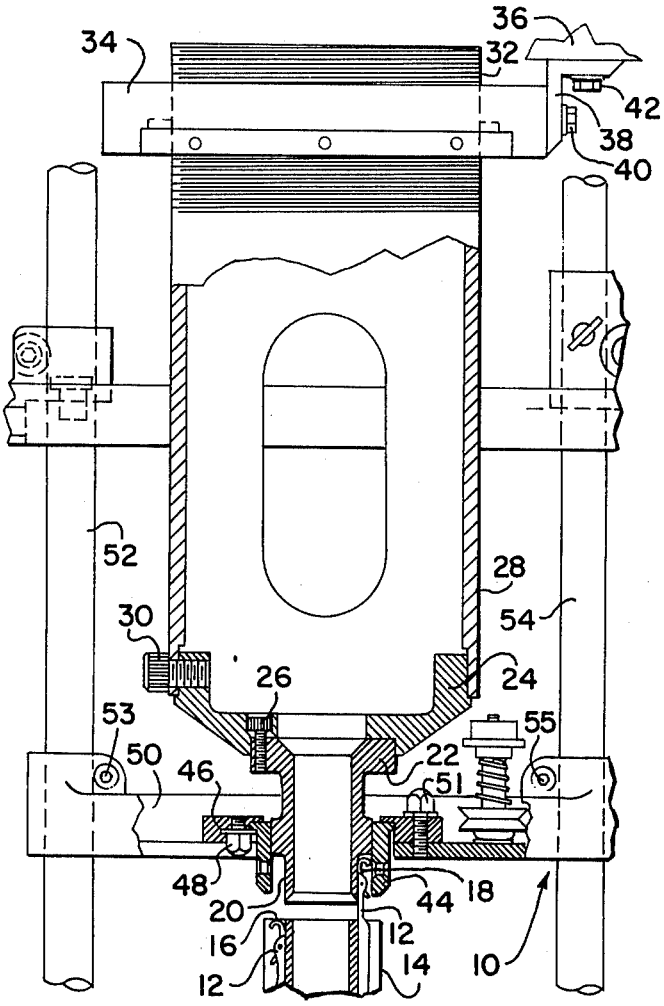
(PRIOR ART) FIG. 1
FIG. 1 is a partial, elevational view of the support tube and hold down ring area of a prior art type circular knitting machine, partially broken away and partly in section to expose details of interior construction.

Although specific terms are used in the following description for the sake of clarity, these terms are intended to refer only to the particular structure of my invention selected for illustration in the drawings, and are not intended to define or limit the scope of the invention.

Inasmuch as the invention resides in the construction of the hold down ring and the yarn guide holder, only so much of the knitting machine proper is shown and described as is needed to identify, locate and describe the function of these parts.

Referring now to the drawings, I shown in FIG. 1 a portion of a conventional, prior art type of circular knitting machine similar to that illustrated in U.S. Pat. No. 3,543,280 generally designated 10 wherein knitting needles 12 are vertically reciprocal within a needle stem 14 and needle cylinder (not illustrated) from a lower position 16 to an upper position 18 for formation of the usual knitting stitches. In the upper position, the knitting needles 12 contact and rub against the exterior periphery of the needle guide portion 20 of the hold down ring 22. An adaptor 24 affixes to the hold down ring 22 by employing a machine screw 26. The adaptor 24 in turn carries the support tube 28 in a rigid connection which is secured by the machine screw 30. The support tube 28 is vertically adjustable for stitch adjustment purposes relative to the needle stem 14 by means of the threaded section 32 which cooperates with the threaded ring 34 for adjustment to any desired vertical position. The threaded ring 34 in turn is rigidly connected to the stationary machine frame 36 in conventional manner such as by employing one or more brackets 38 and a sufficient number of machine screws 40, 42. Thus, the support tube 28 and the hold down ring 22 are rigidly secured in stationary relationship upon the frame 36 to cooperate with the knitting needles 12 during the usual knitting operation.

The yarn guide 44 is secured to the yarn guide holder 46 by the machine screw 48 in well known manner. The yarn guide holder 46 in turn secures to the machine tension ring 50 by means of the machine screw 51 and the tension ring 50 is rigidly connected to the columns 52, 54 conventionally, such as by employing the clamp screws 53, 55. Thus, when the circular knitting machine 10 is operated, the columns 52, 54 rotate the yarn guide 44 about the hold down ring 22 and the cams (not shown) conventionally reciprocate the needles 12. The hold down ring 22 itself remains stationary and the knitting needles 12 reciprocate in the same vertical plane, thereby causing resultant wear in the needle guide portion 20 of the hold down ring 22 as hereinbefore mentioned.

Figure 3:
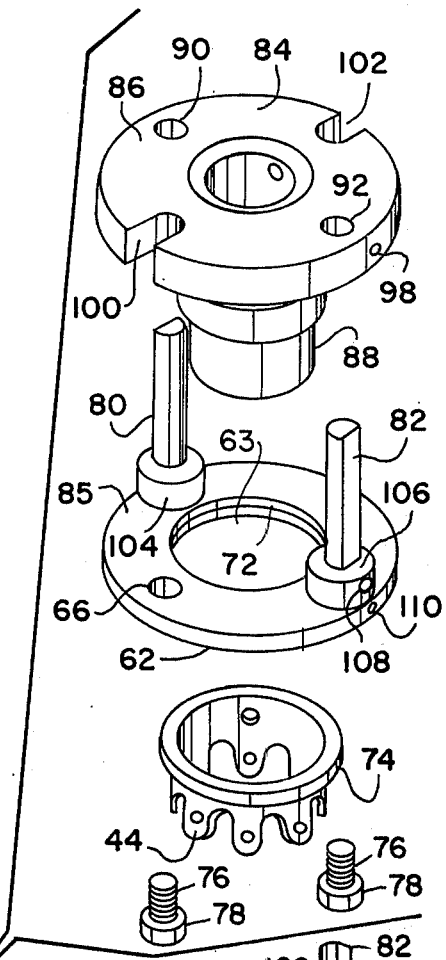
FIG. 3 is an enlarged, exploded, perspective view of the hold down ring, yarn guide holder and yarn guide of FIG. 2.
Figure 4:
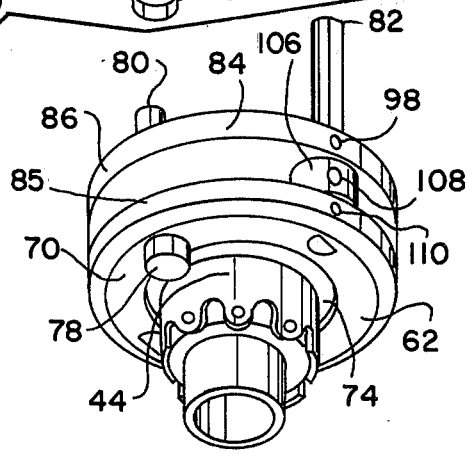
FIG. 4 is a perspective view showing the parts of FIG. 3 in assembled relation.
Figure 2:
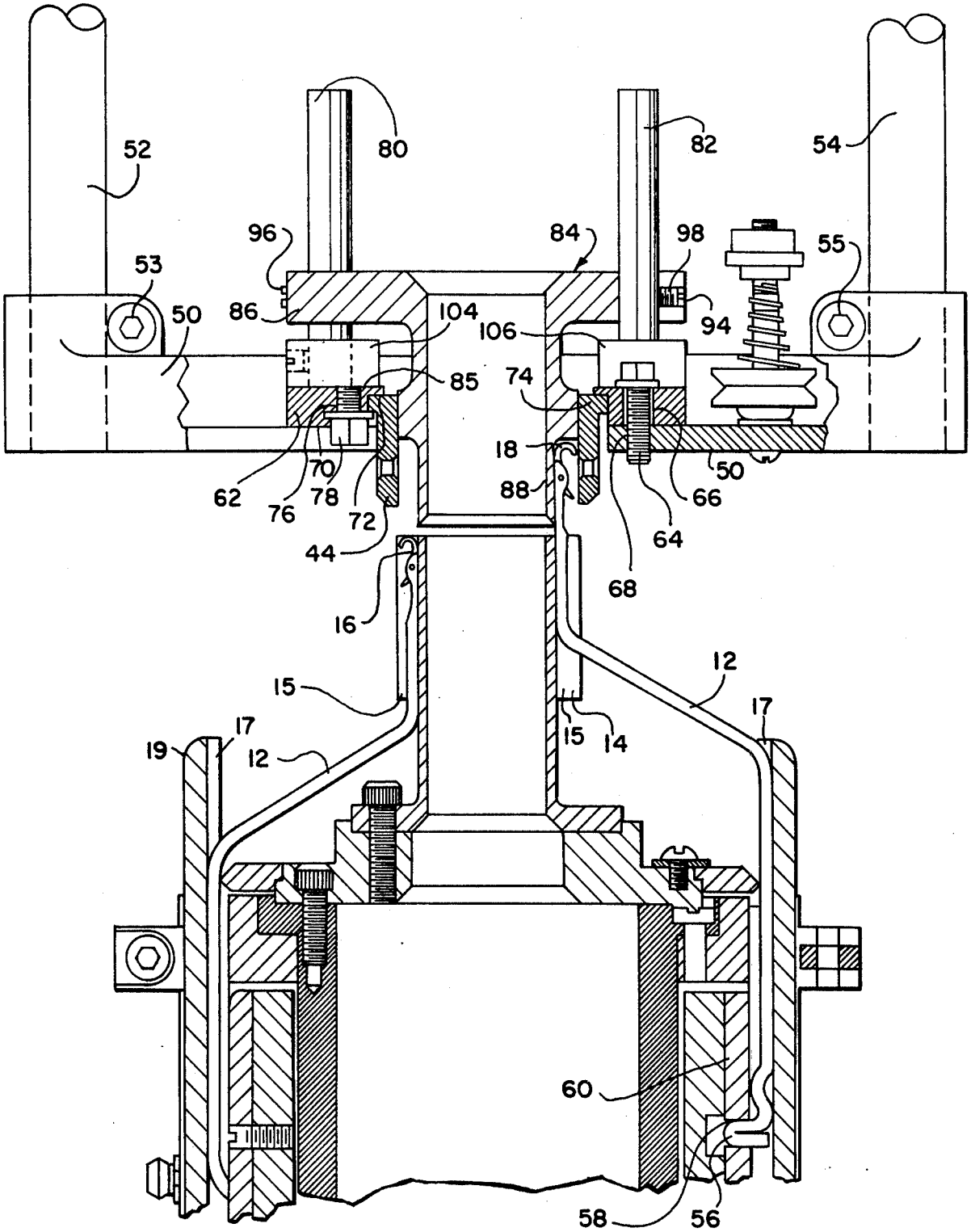
FIG. 2 is an enlarged, partial elevational view of the hold down ring and needle stem areas of a circular knitting machine constructed in accordance with the present invention, partially broken away and partly in section to expose details of interior construction.

Referring now to FIGS. 2, 3 and 4, it will be seen that the knitting needles 12 conventionally vertically reciprocate within the usual vertical slots 15 in the needle stem 14 and in the slots 17 of the needle cylinder or bed 19 between their latch clearing and stitch forming positions 16, 18 by conventionally having their inwardly extending butts 56 engaged in the horizontally extending cam track or tracks 58. The cam rings 60 forming the cam track 58 are rotated upon the operation of the knitting machine to cause vertical reciprocation of the knitting needles 12 in well known manner.

The yarn guide holder 62 of the present invention is shaped in the configuration of a flat annular segment 85 with a central aperture 63 defined therein and is secured to the tension ring 50 by means of machine screws 64 which insert through openings 66 provided in the yarn guide holder and turn into the threaded openings 68 which are tapped or otherwise machined into the tension ring 50. The yarn guide holder 62 is provided with a central aperture 63 to receive a portion of the hold down ring 84 therethrough. The bottom 70 of the yarn guide holder 62 is machined about the aperture 63 to provide a circular recess 72 to receive the flange 74 of the generally hollow cylindrically formed yarn guide 44 in a tight engagement. Machine bolts 76 having enlarged heads 78 secure the yarn guide 44 to the yarn guide holder 62 by engaging the yarn guide flange 74 (see FIG. 2). Thus, as the tension ring 50 is rotated by the rotation of the columns 52, 54, the affixed yarn guide holder 62 and the yarn guide 44 will also rotate.

The yarn guide holder 62 upwardly carries hold down ring attaching means in the form of a pair of diametrically opposed support posts 80, 82 which extend upwardly from the upper surface 85 of the yarn guide holder 62 to facilitate vertical adjustment of the hold down ring 84. The hold down ring is preferably integrally machined to include a horizontally disposed upper support flange 86 and a depending, concentric needle guide portion 88. The support flange 86 is drilled to provide a pair of diametrically opposed openings 90, 92 to respectively receive the support posts 80, 82 therein. Set screws 94, 96 threadedly engage in the threaded openings 98 (only one illustrated) to affix the hold down ring 84 in any desired vertically adjustable position upon the support posts 80, 82. Thus, the spacing between the hold down ring 84 and the needle stem 14 can be easily varied by sliding the hold down ring on the support posts and then locking it in the desired vertical position by means of the set screws 94, 96.

Preferably, the support flange 86 of the hold down ring 84 includes a pair of diametrically opposed, peripherally positioned recesses 100, 102 to facilitate top access to the yarn guide holder machine screws 64. Thus, the yarn guide holder 62 may be secured to the tension ring 50 from the top without the need to remove the hold down ring 84 from its association with the yarn guide holder 62. A pair of spacer collars 104, 106 which are provided with conventional set screws 108 may be provided on the support posts 80, 82 to provide added, readily adjustable support for the hold down ring 84. Additionally, if desired, the support posts 80, 82 may be rendered vertically adjustable relative to the support flange 86 in well known manner such as by employing set screws 110 which turn through the yarn guide holder construction and engage the bottoms of the respective posts 80, 82.

Thus it is seen that a construction has been provided including vertical adjustment means whereby the hold down ring 84 is rendered easily vertically adjustable relative to the needle stem 14 by utilizing the adjustable support posts 80, 82. Further, the hold down ring is affixed to the rotating portion of the circular knitting machine 10 by employing the yarn guide holder 62 and the tension ring 50 to thereby cause the hold down ring 84 to rotate relative to the knitting needles 12 during all periods of machine operation. Thus, the vertical reciprocation of the knitting needles 12 in the same vertical planes will cause portions of the knitting needles to slide against a different segment of the needle guide portion 88 of the hold down ring 84 at each reciprocation. In this manner, the former tendency of the needles 12 to wear grooves within the needle guide portion 88 can be completely eliminated.

Although I have described the present invention with reference to the particular embodiments herein set forth, it is understood that the present disclosure has been made only by way of example and that numerous changes in the details of construction may be resorted to without departing from the spirit and scope of the invention.

Thus, the scope of the invention should not be limited by the foregoing specification, but rather only by the scope of the claims appended hereto.

I claim:

1. In a circular knitting machine of the type having stationary portions and rotating portions and having a stationary needle bed and knitting needles vertically reciprocal relative to the needle bed, the combination of A. a yarn guide holder positioned above the needle bed,
   1. said yarn guide holder being secured to the rotating portions of the machine and having rotary motion relative to the needle bed;

B. a hold down ring secured to the yarn guide holder and being rotated therewith above the needle bed;
   1. the hold down ring including a needle guide portion which is contacted by the knitting needles as they vertically reciprocate; and C. attaching means to affix the hold down ring to the yarn guide holder to cause the hold down ring to rotate relative to the needle bed and the knitting needles during all periods of machine operation, whereby the contacts of the knitting needles will cause even wear about the needle guide portion.

2. The knitting machine of claim 1 wherein the attaching means include vertical adjustment means to permit the hold down ring to be vertically adjusted relative to the needle bed.

3. The knitting machine of claim 2 wherein the vertical adjustment means includes a pair of opposite support posts, said support posts extending upwardly from the yarn guide holder and wherein the height of the support posts is vertically adjustable relative to the yarn guide holder.

4. In a circular knitting machine of the type having stationary portions and rotary portions and having a stationary needle bed and knitting needles vertically reciprocal relative to the needle bed, the combination of A. a yarn guide holder positioned above the needle bed,
   1. said yarn guide holder being secured to the rotary portions of the machine and having rotary motion relative to the needle bed,
   2. said yarn guide holder upwardly carrying, a pair of support posts,
      a. said support posts projecting vertically upwardly from the yarn guide holder,
   3. the said yarn guide holder being shaped in the configuration of a flat annular segment defining a central aperture,
      a. the bottom of the annular segment having a circular recess adjacent the central aperture,
      b. the said yarn guide terminating upwardly in peripheral flange,
      c. a portion of the yarn guide being positioned within the circular recess, the peripheral flange being in contact with the yarn guide holder, the said yarn guide flange seating within the circular recess in the annular segment; and B. a hold down ring associated with the yarn guide holder and secured thereto above the needle bed,
   1. said hold down ring being provided with an upper support flange and a concentric needle guide portion,
      a. said support flange being provided with a pair of openings,
      b. said openings aligning with and receiving thereon the support posts,
      c. said needle guide portion being contacted by the knitting needles as they reciprocate to an upper position to the needle bed,
      d. said needle guide portion being rotated by the rotary portions of the knitting machine to expose differing areas of the needle guide portion to needle contact.

5. The knitting machine of claim 4 wherein the support flange openings are in vertical alignment with the support posts and wherein the hold down ring includes means to vertically adjust the position of the needle guide portion relative to the needle bed by sliding the support post within the opening.

* * * * *